US007479070B2

(12) United States Patent
Hirano

(10) Patent No.: US 7,479,070 B2
(45) Date of Patent: Jan. 20, 2009

(54) GOLF CLUB HEAD AND METHOD FOR MANUFACTURING THE SAME

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 67 days.

(21) Appl. No.: 11/580,827

(22) Filed: Oct. 16, 2006

(65) Prior Publication Data

US 2007/0105657 A1 May 10, 2007

(30) Foreign Application Priority Data

Nov. 4, 2005 (JP) ..... 2005-321193

(51) Int. Cl.
*A63B 53/04* (2006.01)

(52) U.S. Cl. ..... 473/345; 473/349

(58) Field of Classification Search ..... None
See application file for complete search history.

(56) References Cited

U.S. PATENT DOCUMENTS

| | | | | |
|---|---|---|---|---|
| 5,362,055 | A * | 11/1994 | Rennie | 473/342 |
| 5,755,627 | A * | 5/1998 | Yamazaki et al. | 473/345 |
| 6,001,027 | A * | 12/1999 | Hansberger | 473/306 |
| 6,089,070 | A * | 7/2000 | Hancock et al. | 72/340 |
| 6,162,130 | A * | 12/2000 | Masumoto et al. | 473/324 |
| 6,296,576 | B1 * | 10/2001 | Capelli | 473/326 |
| 6,334,817 | B1 * | 1/2002 | Ezawa et al. | 473/324 |
| 6,364,788 | B1 * | 4/2002 | Helmstetter et al. | 473/324 |
| 6,595,871 | B2 * | 7/2003 | Sano | 473/342 |
| 6,719,645 | B2 * | 4/2004 | Kouno | 473/345 |
| 6,875,126 | B2 * | 4/2005 | Yabu | 473/305 |
| 6,881,292 | B2 * | 4/2005 | Chen | 156/293 |
| 6,955,612 | B2 * | 10/2005 | Lu | 473/324 |
| 7,025,693 | B2 * | 4/2006 | Sugimoto | 473/342 |
| 7,247,103 | B2 * | 7/2007 | Beach et al. | 473/324 |
| 2003/0119603 | A1 * | 6/2003 | Yabu | 473/345 |

FOREIGN PATENT DOCUMENTS

| | | | |
|---|---|---|---|
| EP | 288884 | A1 * | 11/1988 |
| EP | 1 338 310 | A2 | 8/2003 |
| JP | 09038249 | A * | 2/1997 |
| JP | 2003-250938 | A | 9/2003 |

* cited by examiner

*Primary Examiner*—Gene Kim
*Assistant Examiner*—Alvin A Hunter
(74) *Attorney, Agent, or Firm*—Birch, Stewart, Kolasch & Birch, LLP

(57) ABSTRACT

A golf club head has a hollow structure comprising a metallic main body provided in a crown portion with a crown opening, and a metallic crown plate fitted in the opening. In order to lower the center of gravity by reducing the weight of the crown portion, the thickness of the crown plate is decreased, and the crown plate is butt welded to the main body without substantial overlap.

11 Claims, 11 Drawing Sheets

GOLF CLUB HEAD AND METHOD FOR MANUFACTURING THE SAME

BACKGROUND OF THE INVENTION

The present invention relates to a golf club head and a manufacturing method therefor, more particularly to a structure of the crown portion of a hollow head including a crown plate being capable of lowering the center of gravity of the head without deteriorating the durability of the joint of the crown plate.

A hollow golf club head (a) of which main body (b) is provided in the crown portion with an opening (o) closed by a crown plate (c) as shown in FIG. 21, has been known for example as disclosed in JP-P2003-250938A. By reducing the weight of the crown plate (c), the center of gravity of the club head (a) can be lowered.

Such club head is provided around the opening (o) of its main body (b) with an annular support (f) for the crown plate to be spliced with a peripheral edge part of the crown plate (c). Hitherto, it has been considered that the strength of the joint of the crown plate (c) and the head main body (b) becomes insufficient if the overlap width (A) therebetween is decreased. Therefore, the width is usually set in a range of more than 5 mm, for example, 15 mm.

Thus, due to the crown-plate support (f) having a relatively large width (A), the weight of the crown portion can not be fully reduced in spite of the lightweight crown plate, and as a result, maximal lowering of the center of gravity is not possible.

SUMMARY OF THE INVENTION

It is therefore, an object of the present invention to provide a golf club head, in which, the conventional crown-plate support provided around the opening can be minimized or almost cut out, without decreasing the durability of the joint of the crown plate, and thus, a further lowering of the center of gravity is possible.

According to the present invention, a golf club head having a hollow structure comprising a metallic main body provided in a crown portion with a crown opening and a metallic crown plate fitted in the opening, wherein the edge of the crown plate is butt welded to the edge of the main body around the crown opening.

Therefore, the conventional crown-plate support provided around the opening can be cut out, without decreasing the durability of the joint. Accordingly, the weight of the crown part of the head can be reduced, and it becomes possible to lower the center of gravity of the head.

Incidentally, upon lowering the center of gravity of the head, the sweet spot shifts towards the sole portion of the head, and the probability of hitting a ball at a position on the upper side of the sweet spot SS becomes high. As a result, at impact, the club head makes a slight rotation (in FIG. 2, clockwise) around the center of gravity G and the ball is provided with a larger shot angle and a lower backspin due to the so called vertical gear effect. Therefore, the carry distance of the ball may be increased.

DESCRIPTION OF THE PREFERRED EMBODIMENTS

Figure 1:
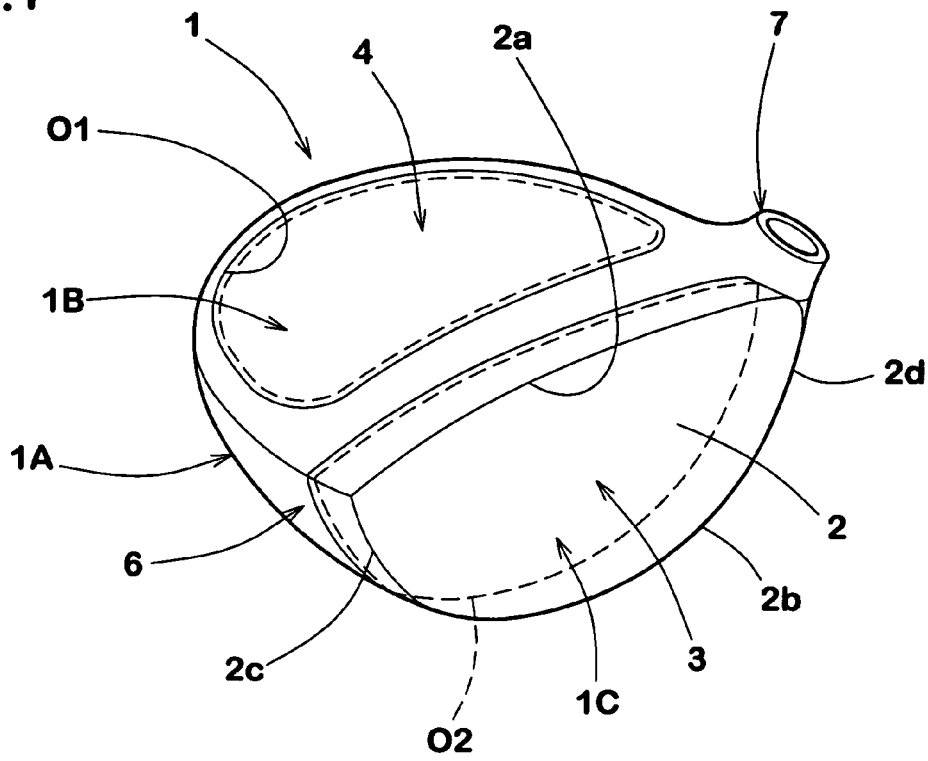
FIG. 1 is a perspective view of a wood-type golf club head according to the present invention.

Embodiments of the present invention will now be described in detail in conjunction with the accompanying drawings.

In the drawings, golf club head 1 according to the present invention is a wood-type hollow head 1.

Figure 2:
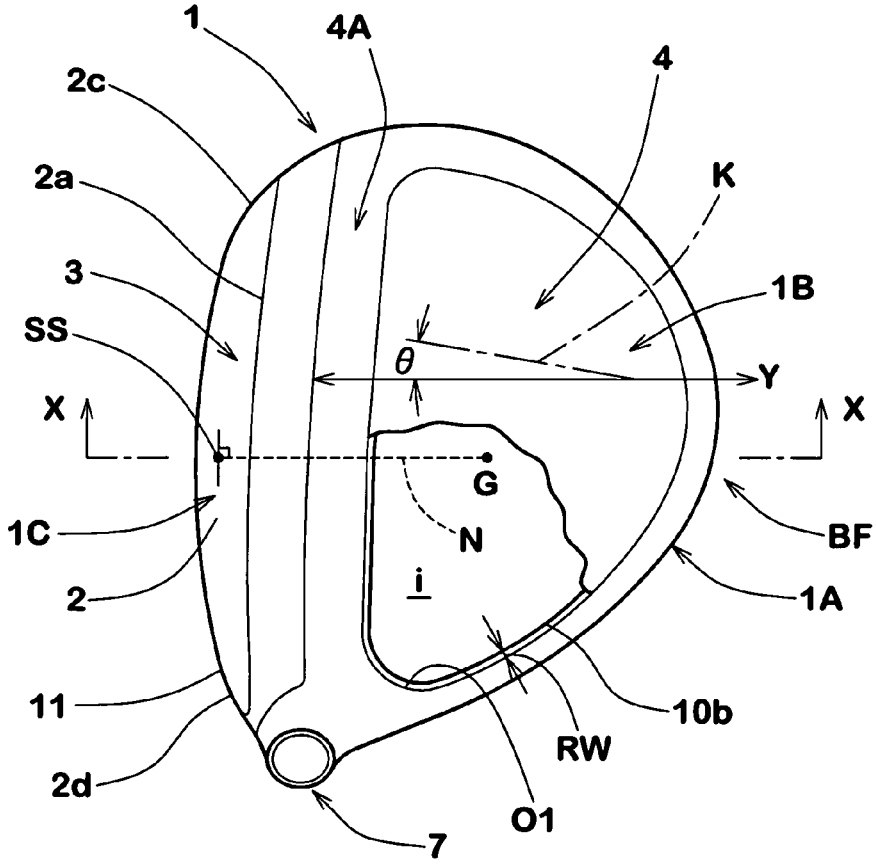
FIG. 2 is a top view thereof.
Figure 3:
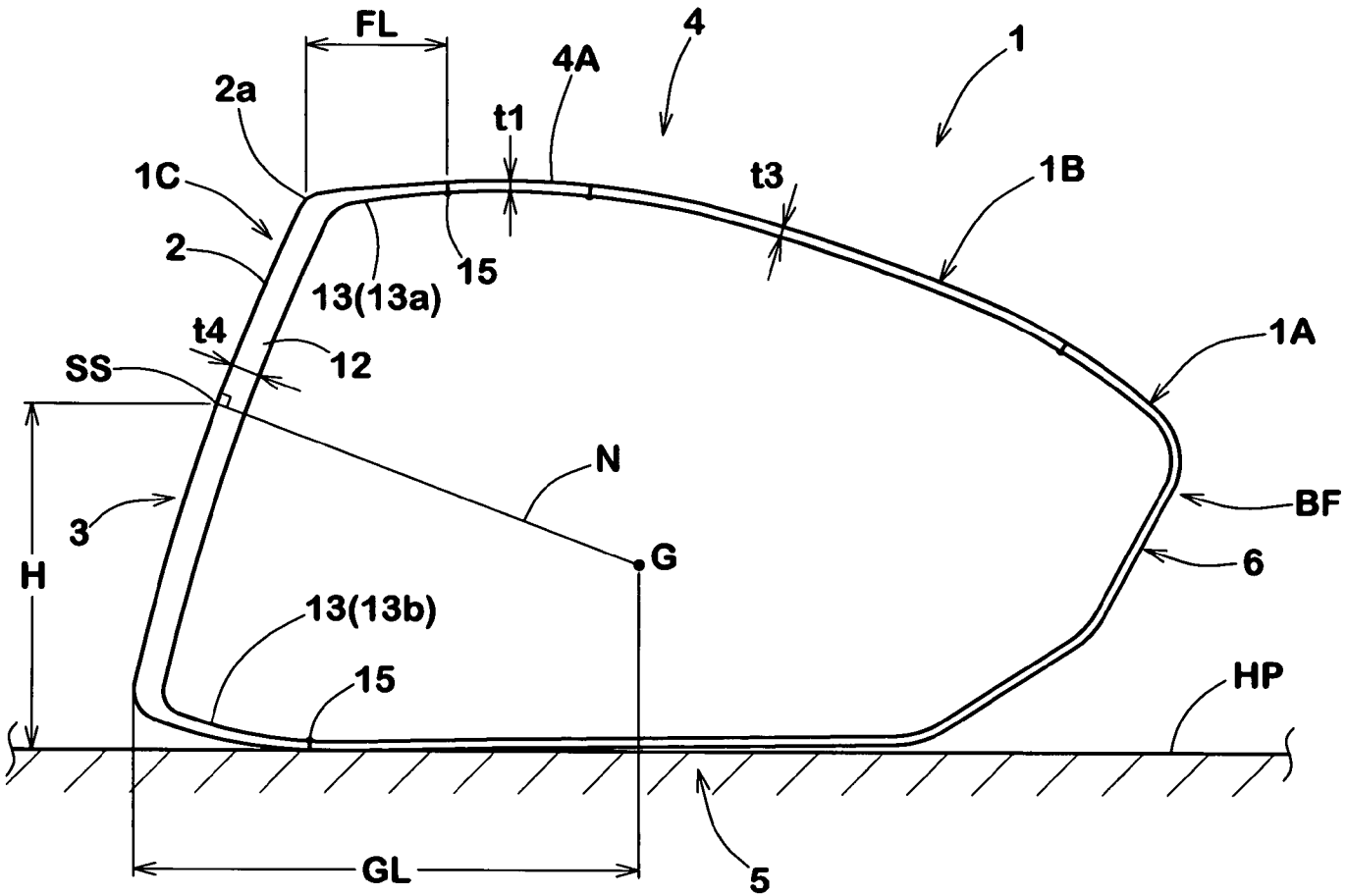
FIG. 3 is a cross sectional view of the head taken along line X-X of FIG. 2.

As shown in FIGS. 1, 2 and 3, the head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 to be attached to an end of a club shaft (not shown).

Figure 4:
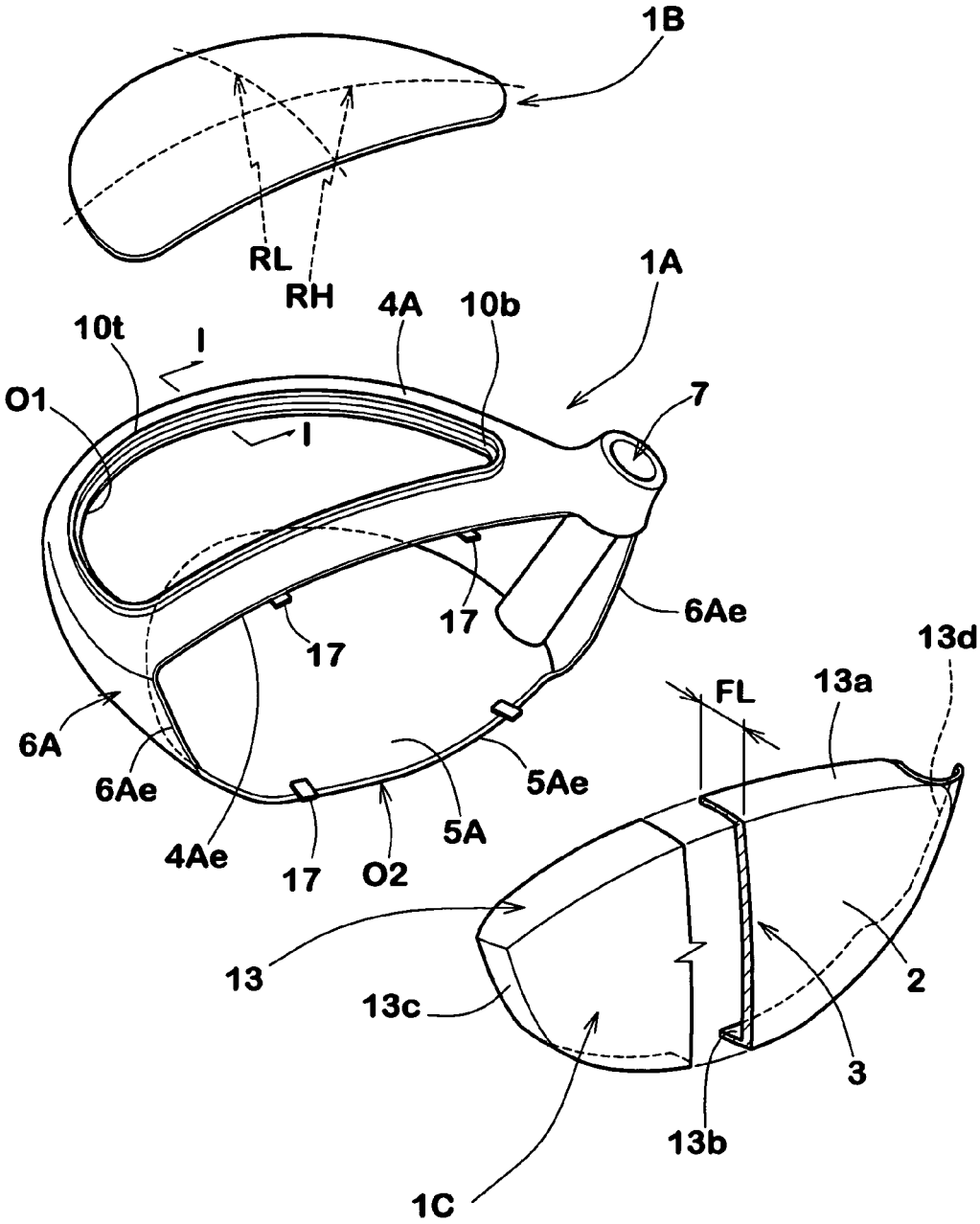
FIG. 4 is an exploded perspective view of the head showing a head main body, a crown plate and a face plate with a turnback.

According to the present invention, the crown portion 4 is provided with a crown opening O1 which is closed by a crown plate 1B. In this embodiment, as shown in FIG. 4, the club head 1 has a three-piece structure composed of the above-mentioned crown plate 1B forming a most part of the crown portion 4, a face plate 1C forming the face portion 3, and a hollow main body 1A as the remainder. The main body 1A is provided with the above-mentioned crown opening O1 and further a front opening O2. The front opening O2 is closed by the face plate 1C.

In order to increase the moment of inertia of the club head 1 to minimize undesirable motions of the club head at a missed shot and thereby to improve the directional stability, and to allow to provide a larger crown opening to further the crown weight reduction, the head volume is preferably set in a range of not less than 400 cc, more preferably more than 420 cc, still more preferably more than 430 cc. However, in view of the club weight, swing balance, durability and the like, the head volume is preferably not more than 470 cc.

Further, in view of the swing balance, the weight of the club head 1 is preferably not less than 175 grams, more preferably more than 180 grams, but preferably not more than 210 grams, more preferably less than 205 grams.

*Face Plate*

The face plate 1C forms the substantially entirety of the face portion 3, and thus, the front face thereof defines the club face 2.

For the face plate 1C, titanium alloys such as Ti-15V-3Cr -3Al-3Sn, Ti-22V-4Al(DAT51), Ti-6Al-4V, Ti-13V-11Cr-3Al and Ti-4.5A]-2.0Mo-1.6V-0.5Fe are preferably used.

The thickness of the face plate 1C or the thickness t4 of the face portion 3 is preferably not less than 3.00 mm, more preferably not less than 3.05 mm, still more preferably not less than 3.10 mm. when the thickness t4 is increased, the depth GL of the center of gravity G decreases, and the moment of inertia tends to decrease. Therefore, the thickness t4 is preferably not more than 3.40 mm, more preferably not more than 3.35 mm, still more preferably not more than 3.30 mm.

The face portion 3 in this example has a substantially constant thickness t4. But, the thickness t4 may be variable. For instance, while maintaining the thickness in the central zone including the sweet spot SS to provide durability, the thickness in the peripheral zone surrounding the central zone can be reduced to improve the rebound performance.

In this embodiment, the face plate 1C is provided with a turnback 13 along at least partially of the edge 2*a*-2*d* of the club face 2. The turnback 13 is formed integrally with the face plate 1C by a pressing bend method, casting method, forging method or the like. In other words, they are not separate parts jointed.

The turnback 13 in this example is, as shown in FIG. 4, formed along the almost entire length of the edge of the face plate 1C excluding a position corresponding to the hosel portion 7. Therefore, the turnback 13 includes: an upper turnback 13*a* forming a front end zone of the crown portion 3; a lower turnback 13*b* forming a front end zone of the sole portion 4; a toe-side turnback 13*c* forming a front end zone of the side portion 5 on the toe-side; and a heel-side turnback 13*d* forming a front end zone of the side portion 5 on the heel-side.

*Main Body*

In the FIG. 4 example, since the upper turnback 13*a*, lower turnback 13*b*, toe-side turnback 13*c* and heel-side turnback 13*d* extend backwards from the edge 2*a*-2*d* of the club face 2, the main body 1A is made up of: a sole main part 5A which is a major part of the sole portion 5; a side main part 6A which is a major part of the side portion 6; the above-mentioned hosel portion 7, and a crown peripheral part 4A which is a part of the crown portion 4 surrounding the crown opening O1. The front opening O2 is encircled by the front edges 4Ae, 5Ae and 6Ae of the parts 4A, 5A, and 6A.

The head main body 1A in this example is a single piece of a metal material, although the main body 1A may be an assemblage of two or more separate pieces.

Metal materials having a relatively large specific gravity, for example, stainless steels and maraging steels, and further pure titanium, titanium alloys (for example Ti-6Al-4V) and the like can be preferably used to make the main body 1A.

In order to lower the center of gravity of the head by reducing the weight of the crown portion 4, the area of the crown opening O1 is preferably not less than 40 sq.cm, more preferably not less than 50 sq.cm. But, in view of the durability of the crown portion 4, the area is preferably not more than 75 sq.cm, more preferably not more than 65 sq.cm.

Here, the area of the crown opening O1 is the area projected on a horizontal plane HP under the standard state of the club head as shown in FIG. 2.

The standard state is such that the head is put on the horizontal plane HP, maintaining its lie angle and loft angle.

Although the crown opening O1 may be formed to protrude from the crown portion 4 to the side portion 6, in this embodiment, the crown opening O1 is formed within the crown portion 4, whereby the above-mentioned crown peripheral part 4A extends continuously and annularly around the crown opening O1.

Figure 18:
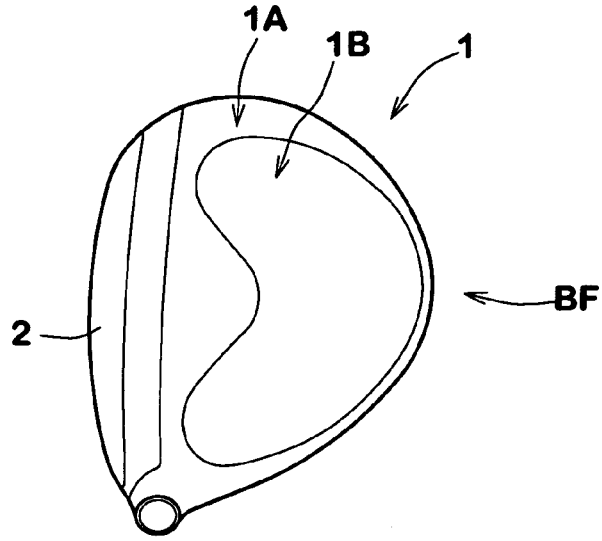
FIGS. 18, 19 and 20 are top views each showing another example of the crown opening.
Figure 19:
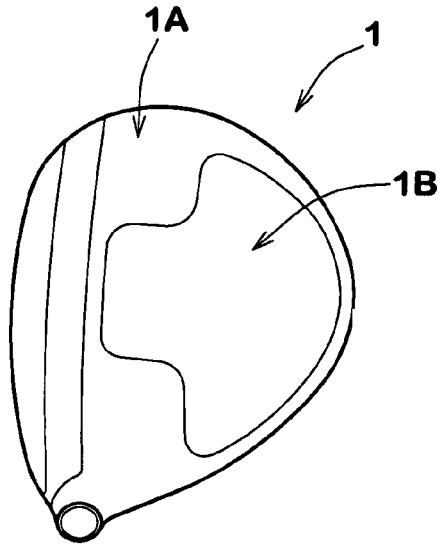
Figure 20:
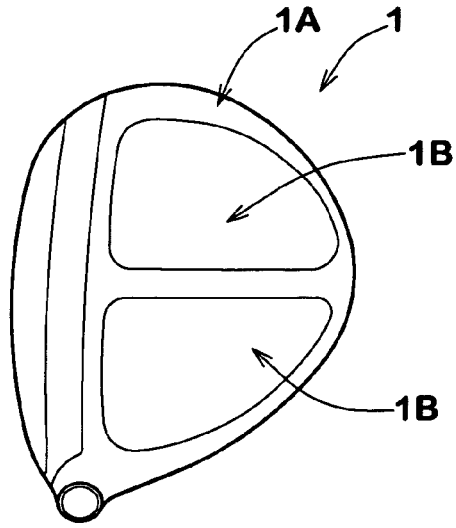
Figure 21:
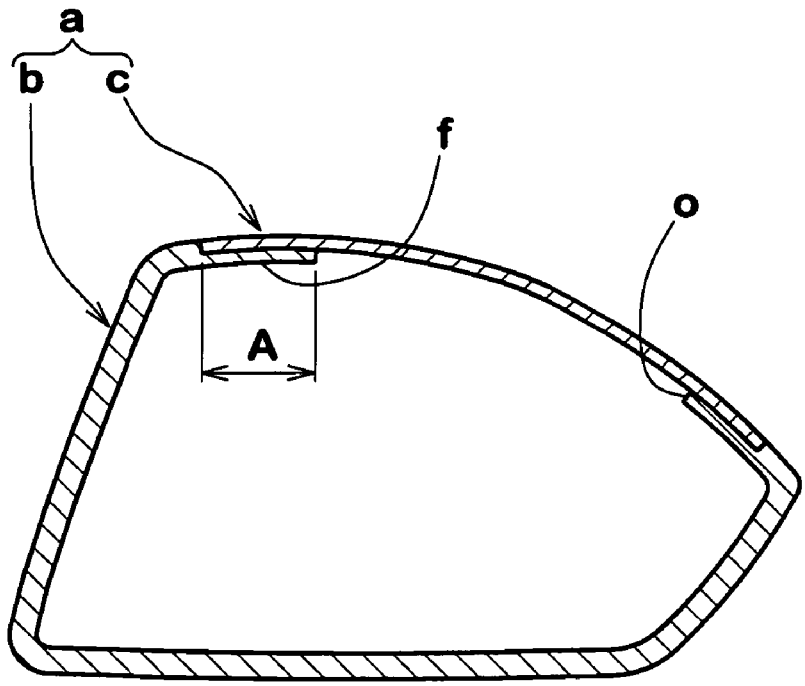
FIG. 21 is a cross sectional view of the prior-art golf club head.

As to the shape of the crown opening O1, preferably employed is a shape similar to but a little smaller than the shape of the crown portion 4 as shown in FIG. 4. But, various shapes as shown in FIG. 18, 19 and 20 may be employed as explained later.

*Crown Plate*

The crown plate 1B is made of a metal material having a specific gravity smaller than that of the head main body 1A in order to lower the center of gravity G of the head.

For example, titanium alloys are preferably used. Especially, Beta-type titanium alloys such as Ti-15V-3Cr-3A1-3Sn and Ti-4.5Al-3v-2Mo-2Fe(SP700) having a relatively large specific gravity and being excellent in ductility are preferably used in this embodiment.

The crown plate 1B is curved such that the curvature has, as shown in FIG. 4, a radius RL in a vertical plane parallel to the back-and-forth direction of the head and a radius RH in a vertical plane parallel to the toe-and-heel direction.

In view of the durability and weight, the thickness t3 of the crown plate 1B is preferably not less than 0.30 mm, more preferably not less than 0.35, still more preferably not less than 0.40 mm, but not more than 0.70 mm, more preferably not more than 0.60 mm, still more preferably not more than 0.55 mm.

The ratio (t1/t3) of the thickness t1 of the crown peripheral part 4A to the thickness t3 of the crown plate 1B is preferably not less than 1.20, more preferably not less than 1.35, more preferably not less than 1.50, but not more than 2.00, more preferably not more than 1.80. If the ratio (t1/t3) is less than 1.20, the weight reduction in the crown portion 4 is liable to become insufficient. If more than 2.00, a weight increase or a decrease in the crown plate strength tends to occur.

Figure 5:
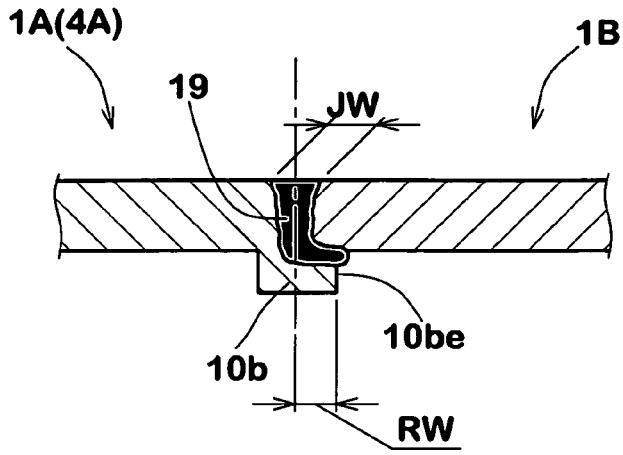
FIGS. 5 and 6 are enlarged cross sectional views each showing a favorable example of the welded butt joint.
Figure 6:
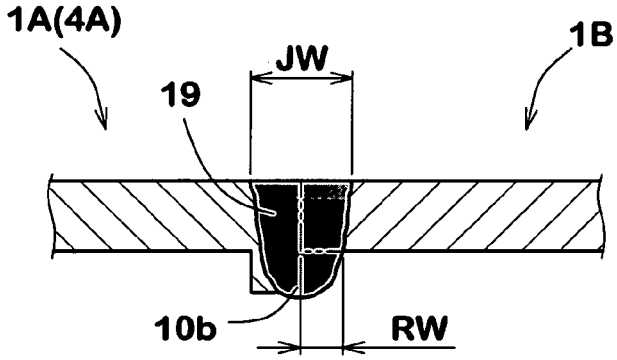

The contour shape of the crown plate 1B is almost same as but a little smaller than the shape of the crown opening O1 so that, when the crown plate 1B is fitted in the crown opening O1, a micro gap is formed therebetween and the edge of the crown plate 1B and the edge of the crown peripheral part 4A can be butt welded as shown in FIGS. 5 and 6 with the gray representing the fusion zone 19.

The fusion zone 19 extends from the outer surface of the crown portion 4 toward the inside of the head and reaches to the depth corresponding to the thickness t3 of the crown plate 1B.

If the fusion zone 19 is too narrow in width JW, the joint strength is liable to become insufficient. If too wide, the production efficiency tends to decrease because the quantity of finishing work such as grinding and polishing is increased thereby. Therefore, the width JW of the fusion zone 19 is preferably at least 1.5 mm, more preferably at least 2.0 mm, but at most 3.0 mm, more preferably at most 2.5 mm when measured at the outer surface of the crown portion 4.

*Process of Manufacturing Main Body*

The above-mentioned main body 1A can be manufactured by assembling two or more separate pieces which are prepared through appropriate methods such as forging, rolling and bending. However, the head main body 1A in this example is manufactured as a single casting of the above-mentioned metal material by a lost-wax precision casting.

Figure 8:
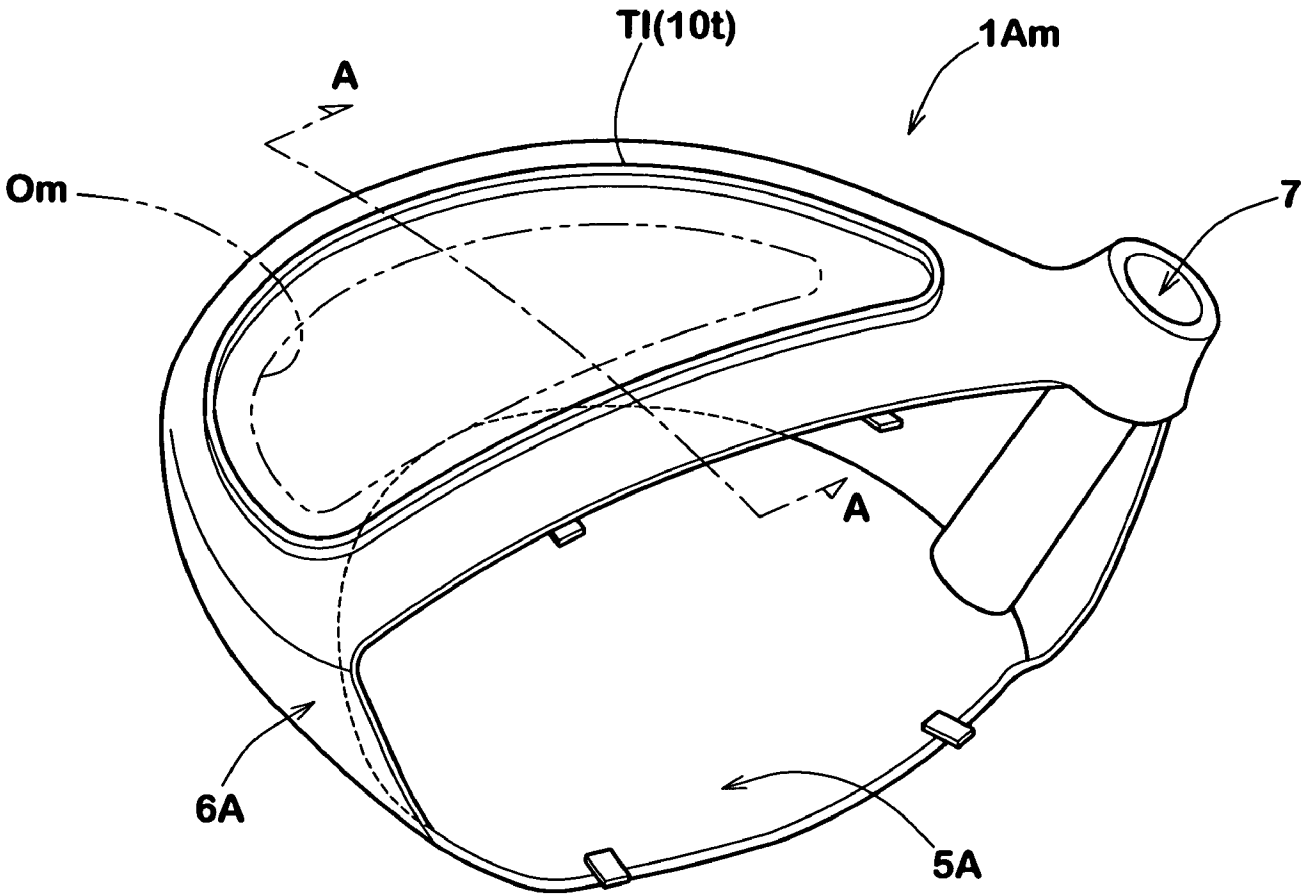
FIG. 8 is a perspective view of a primary casting which becomes the head main body by being provided with a crown opening.

Firstly, a casting 1Am is prepared in order to manufacture the head main body 1A. This primary casting 1Am is, as shown in FIG. 8, almost same as the head main body 1A except that the crown opening O1 is not yet provided. The expression "the crown opening O1 is not yet provided" means that the crown opening O1 with the exact size or shape is not formed in the exact position. Therefore, the primary casting 1Am is (1) a casting provided with no opening, or (2) a casting provided with an opening Om smaller than the target crown opening O1.

In either case, along the edge of the crown opening O1 to be formed, a thickness-increased part TI is molded. This thickness-increased part TI protrudes from the outer surface of the crown portion 4, and also protrudes from the outside to the inside of the edge 10*ae* of the crown opening O1 to be formed, as shown in FIG. 10 to the right thereof.

*Process of Forming Crown Opening*

Then, through the use of laser beam machining, the crown opening O1 is formed on the primary casting 1Am.

Figure 10:
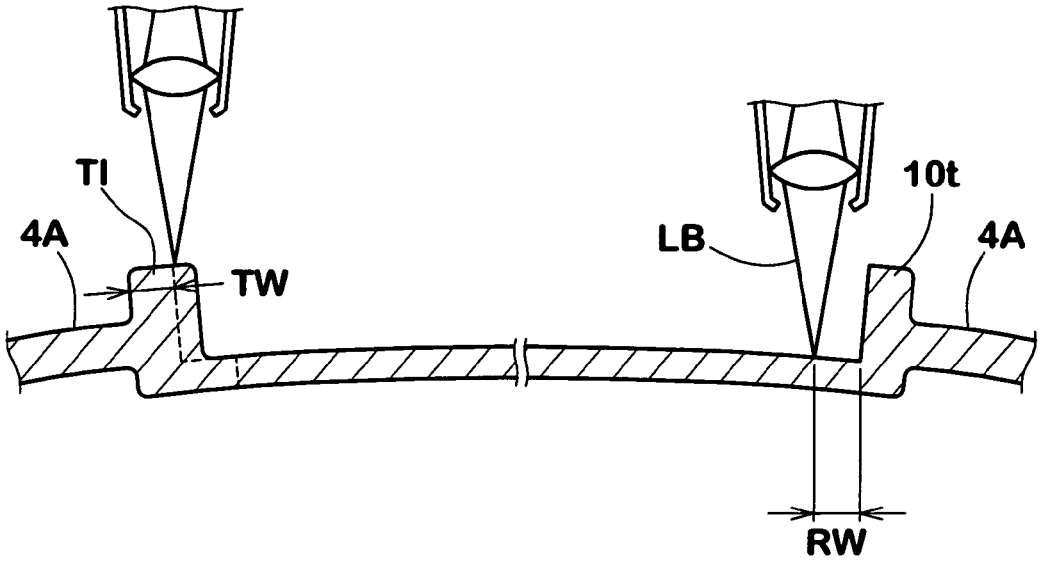
FIGS. 10 and 11 are cross sectional views for explaining a method of forming the crown opening.
Figure 11:
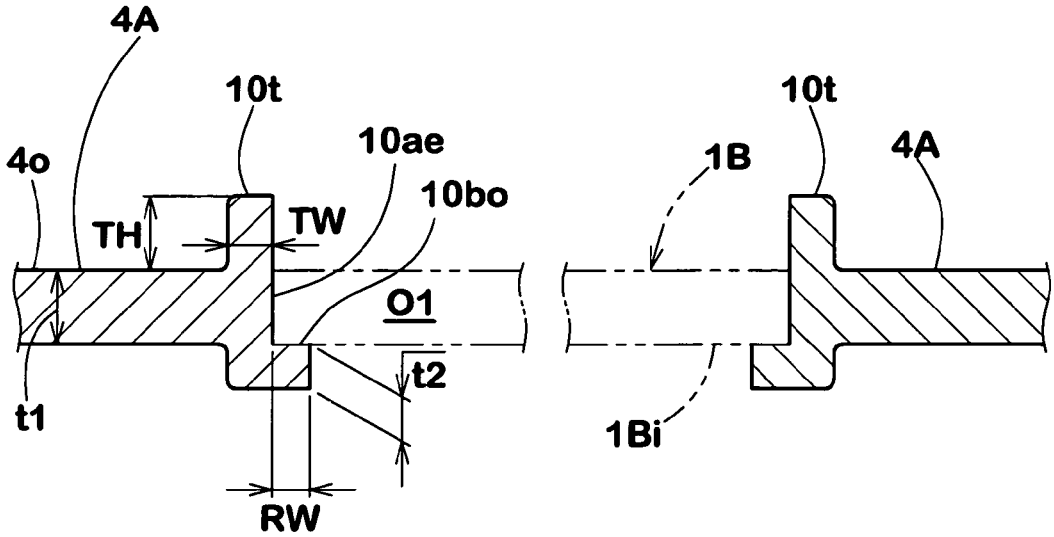

In this laser beam machining process, as shown in FIG. 10, a laser beam LB is irradiated to the thickness-increased part TI, and the edge 10*ae* of the crown opening O1 is formed. As a result, by the remainder of the thickness-increased part TI, a rib 10*t* is formed along the edge 10*ae* of the crown opening O1.

If the above-mentioned crown peripheral part 4A on the outside of the thickness-increased part TI is too thin, it is difficult to provide durability for the crown portion 4 and it becomes difficult to cast such a thin plate. Therefore, the thickness t1 of the crown peripheral part 4A is preferably not less than 0.6 mm, more preferably not less than 0.7 mm. But, in view of the weight reduction in the crown portion 4, the thickness t1 is preferably not more than 0.9 mm, more preferably not more than 0.8 mm.

As explained above, the thickness t1 of the crown peripheral part 4A is very small. If there is no rib, the depth of the opening or hole in which the very thin crown plate 1B is fitted becomes very shallow. Accordingly, the crown plate 1B is easy to dislocate during assembling the head. However, by providing the rib 10*t*, such dislocation can be prevented. It is therefore, preferable that the maximum height TH of the rib 10*t* is at least 0.8 mm, more preferably 1.0 mm or more. But, in order to remove the rib from the finished head without consuming time, it is preferable that the maximum height TH is not more than 1.8 mm, more preferably not more than 1.5 mm. For the same reason, the maximum width TW of the rib 10*t* is preferably at least 0.6 mm, more preferably at least 0.7 mm, but at most 1.2 mm, more preferably at most 1.0 mm.

Due to the forming process, the rib 10*t* extends continuously and annularly along the edge 10*ae* of the crown opening O1, but it may be possible to form the rib 10*t* discontinuously.

*Process of Forming Crown-Plate Support*

Further, through the use of the laser beam machining, the crown-plate support 10*b* protruding to the crown opening O1 as shown in FIG. 4 is formed.

In the present invention, the crown-plate support 10*b* is prepared for the purpose of temporarily supporting and positioning of the crown plate during welding the crown plate to the head main body. Accordingly, a protrusion of at most 0.8 mm is sufficient to such purpose.

In the present invention, therefore, the width RW of the crown-plate support 10*b* measured perpendicularly to a tangent to the edge 10*ae* of the crown opening O1, namely, the amount of protrusion from the edge 10*ae* of the crown opening O1 is set in a range of at most 0.8 mm, preferably not more than 0.70 mm, more preferably not more than 0.65 mm, but at least 0.3 mm, preferably at least 0.40 mm, more preferably at least 0.50 mm. In the FIG. 4 example, the width RW is constant, but the width RW can be a variable value.

In order that the width RW satisfies the above limitation, by irradiating the laser beam LB at the position corresponding to RW, the inner end or side face 10*be* of the crown-plate support 10*b* is formed.

Furthermore, by the laser beam machining, the outer face 10*bo* of the crown-plate support 10*b* on which the crown plate 1B is placed is formed at a certain depth so that the outer surface of the crown plate 1B becomes substantially flush with the outer surface of the crown peripheral part 4A when the crown plate is fitted in the crown opening O1.

As the width RW and the depth of the outer face 10*bo* are very small, it is very difficult to form the crown-plate support 10*b* with precision by the casting method only without utilizing the laser beam machining.

In FIG. 4, the crown-plate support 10*b* is continuous along the edge 10*ae* of the crown opening O1.

Figure 9:
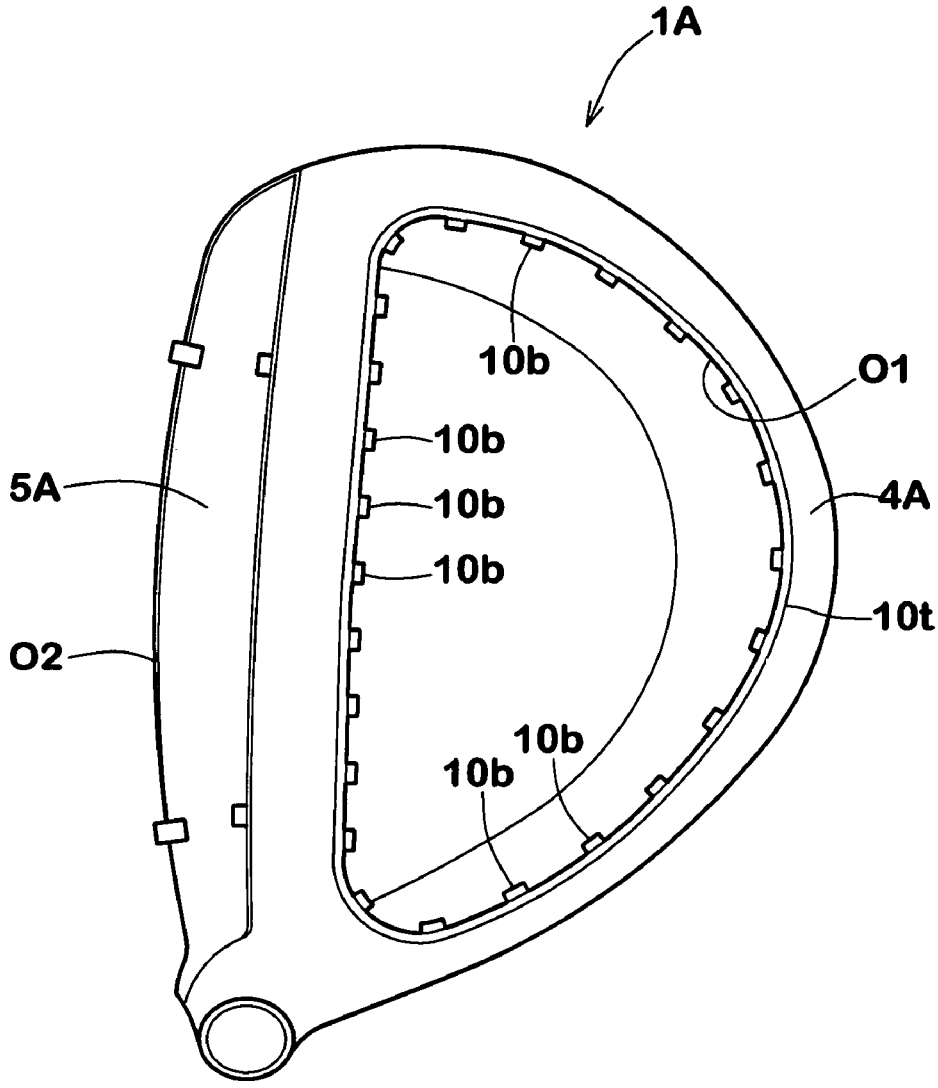
FIG. 9 is a top view of a head main body showing another example of the crown-plate support which is discontinuous in contrast to that shown in FIG. 4.

However, as shown in FIG. 9, the crown-plate support 10*b* can be discontinuous along the edge 10*ae* of the crown opening O1. In this case, in order to secure a sufficient joint strength, the total length of the crown-plate support 10*b* along the edge 10*ae* of the crown opening O1 is set in a range of at least 30%, preferably not less than 50%, more preferably not less than 70% of the inside perimeter of the crown opening O1.

The maximum thickness t2 of the crown-plate support 10*b* is preferably at least 0.60 mm, more preferably not less than 0.65 mm, but at most 0.85 mm, more preferably not more than 0.70 mm. To secure the thickness t2, the above-mentioned thickness-increased part TI also protrudes from the inner surface of the crown peripheral part 4A as shown in FIG. 10.

*Process of Manufacturing Crown Plate*

The crown plate 1B may be formed by casting or forging a metal material. But, in such a case, as the crown plate 1B is unusually thin, structural defects or uneven residual stress distribution inherent in such processes tends to deteriorate the durability of the plate. Therefore, the use of a rolled metal material gradually extended into the predetermined uniform thickness is preferred because the structural defects and uneven residual stress distribution are minimized.

In this embodiment, therefore, the crown plate 1B is manufactured from a rolled metal plate.

Figure 12:
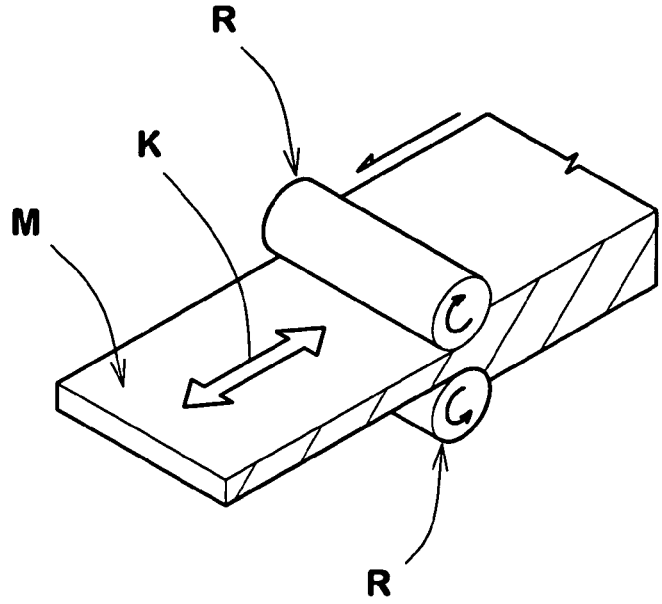
FIGS. 12, 13 and 14 are schematic views for explaining a method of manufacturing the crown plate.

As shown in FIG. 12, the metal material M for the crown plate 1B is extended in a direction K, while passing through between rollers R. Before subjected to the rolling process, the metal material may be subjected to a casting process, forging process, grinding process and the like. After the rolling process, the rolled metal plate may be subjected to a press bending process, punching process, cutting process and the like. Further, such processed plate may be subjected to a heat treatment process. Thus, due to the work hardening, the mechanical characteristics are improved, and a homogeneous crystal structure having less defect can be obtained.

Figure 13:
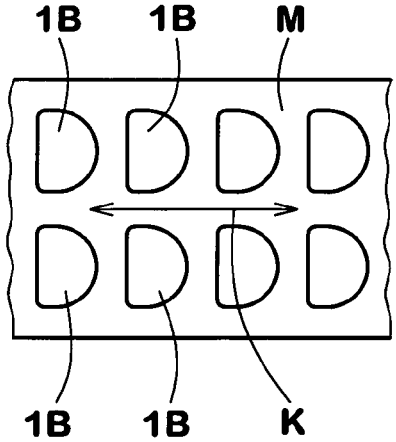

Next, as shown in FIG. 13, from the rolled metal plate M, the crown plate 1B is punched out, aligning the extended direction K with the back-and-forth direction of the head for the undermentioned reason.

Figure 14:
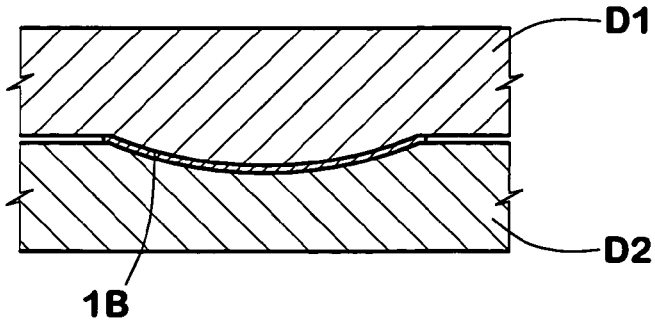

Then, as shown in FIG. 14, by pressing between the dies D1 and D2, the crown plate 1B is shaped to have a curvature. The curvature has, as shown in FIG. 4, a radius RL in a vertical plane parallel to the back-and-forth direction of the head and a radius RH in a vertical plane parallel to the toe-and-heel direction.

Finally, edge trimming is made as needed.

*Rolled Metal Plate*

In general, a rolled metal plate is extended a plurality of times, changing the extending. direction in order to eliminate anisotropy of characteristics. In this embodiment, however, the rolled metal plate is extended more in one direction K than other directions to intentionally provide anisotropy. since the crystal grains in the rolled metal plate are oriented in the extended direction K, the resultant crown plate 1B has a strength anisotropy and the Young's modulus increases in the direction K. The crown plate 1B is, at impact, subjected to a large stress in the back-and-forth direction Y. Therefore, the strain of the crown portion 4 at impact can be reduced by substantially aligning the directions K and Y. This will improve the durability and can decrease the energy loss to improve the rebound performance. In the heel-and-toe direction orthogonal to the back-and-forth direction Y, on the other hand, the Young's modulus of the crown plate 1B becomes relatively small. As a result, the shock at impact can be mitigated and the shot feeling may be improved.

Therefore, the angle θ between the extended direction K and the back-and-forth direction Y is set in a range of not more than 20 degrees, preferably not more than 10 degrees, more preferably not more than 5 degrees, most preferably 0 degree.

The back-and-forth direction Y of the club head is, as shown in FIG. 2, defined as being parallel to the direction of the straight line N extending between the sweet spot SS and the center of gravity G which is projected on the horizontal plane HP under the standard state of the head.

In the crown plate 16, the above-mentioned extended direction K is defined at the centroid of the contour shape of the crown plate 1B projected on the horizontal plane HP under the above-mentioned standard state of the head.

The extended direction K of the rolled material M can be determined as the major elongated direction of crystal grains in the metallic crystal structure, which can obtained by making an observation about the crystal grains with the use of an electronic microscope.

*Welding of Crown Plate and Main Body*

As explained above, the edge 1Be of the crown plate 1B is butt welded to the edge 10*ae* of the main body around the crown opening O1 by utilizing laser welding.

As the crown plate 1B is very thin, if another welding method, for example, plasma welding is employed, the heat during welding spreads to a wide range around the welded joint. As a result, the crown plate 1B tends to burn through or deform. Further, the metallic crystal structure is liable to be metamorphosed. These problems, however, can be solved by utilizing laser welding because a pinpoint irradiation is possible.

In the case of laser welding, due to the pinpoint irradiation, if the gap between the crown plate 1B and the crown opening O1 is wide, it is difficult to weld. To achieve an effective wilding, the gap should be as small as possible. Accordingly, with respect to the shape, the crown opening as well as the crown plate has to be formed with a high degree of accuracy. Therefore, in this embodiment, lasering is utilized to form the crown opening O1 in the crown portion of the head main body 1A as described above.

Figure 15:
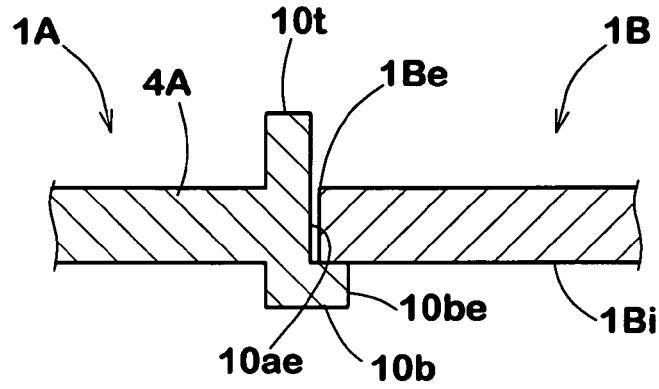
FIGS. 15, 16 and 17 are schematic cross sectional views for explaining a method of welding the crown plate.

As shown in FIG. 15, the crown-plate support 10*b*, which has been formed to have the outer surface 10*bo* set back from the outer surface of the crown peripheral part 4A, protrudes by the small amount RW. When the crown plate 1B is fitted in the crown opening O1, the inside face 1Bi of the crown plate 1B comes into contact with the outer surface 10*bo*, and the crown plate 1B is temporarily supported in place such that the outer surface of the crown plate 1B becomes substantially flush with the outer surface of the crown peripheral part 4A.

Figure 16:
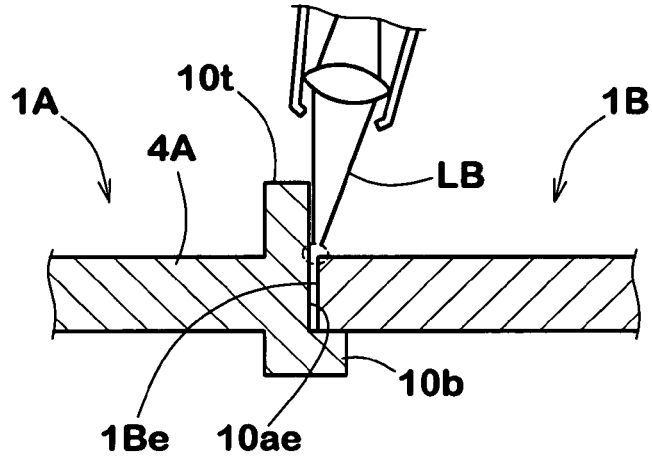

As shown in FIG. 16, from the outside of the club head 1, a laser beam LB is irradiated towards the micro gap between the edge 1Be of the crown plate 1B and the edge 10*ae* of the crown opening O1.

Figure 17:
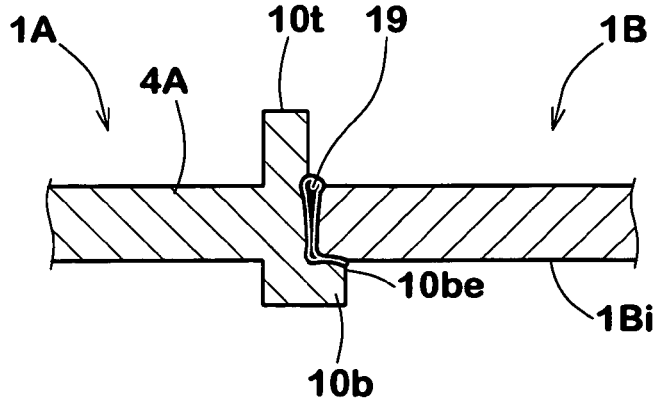

As shown in FIG. 17, the fused metal fills the micro gap, and penetrates into the interface between the crown plate 1B and the crown-plate support 10*b* because the width RW is small. As a result, the fusion zone 19 is formed substantially all over the interface.

Figure 7:
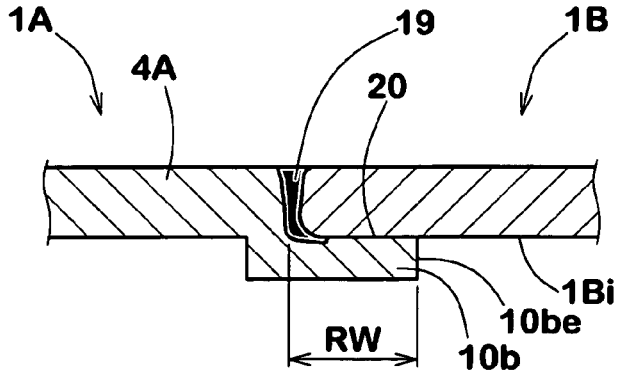
FIG. 7 is a cross sectional view showing an example of the welded butt joint which is not favorable.

If the width RW is more than 0.8 mm, as shown in FIG. 7, the fusion zone 19 can not be reached to the end 10*be* of the crown-plate support 10*b*. In this case, crack is liable to start from the interface 20 not welded, and the durability of the joint tends to decrease.

Accordingly, not to form such unwelded part 20, the width RW is set in the above-mentioned very small value range of not less than 0.3 mm, but not more than 0.8 mm.

As to the extent of the fusion zone 19, as far as the fusion zone 19 reaches to the end 10*be* of the crown-plate support 10*b*, even if the outside of the crown-plate support 10*b* is remained almost intact as shown in FIG. 5, a sufficient joint strength will be obtained. But, as shown in FIG. 6, if the fusion zone 19 engulfs the crown-plate support 10*b*, the joint strength may be further increased.

During irradiating the laser beam LB, the above-mentioned rib 10*t* facilitates to lessen the heat transmitted to the crown peripheral part 4A. Further, the fused rib 10*t* is utilized as the filler metal material between the gap. Usually, the rib 10*t* is removed by machining after the crown plate 1B is welded. But, it may be left to utilize for an ornamental propose or the like.

*Welding of Face Plate and Main Body*

The face plate 1C is attached to the head main body 1A by butt welding the turnbacks 13*a*, 13*b*, 13*c* and 13*d* to the crown peripheral part 4A, sole main part 5A, side main part 6A on the toe-side and side main part 6A on the heel-side of the main body 1A, respectively.

For the purpose of supporting and positioning the face plate 1C, the head main body 1A can be provided along the edge of the front opening O2 with projections 17.

As the method of welding, in this example, laser welding is employed.

Due to the turnback 13, the butt welding becomes possible without reducing the joint strength. Further, the welded butt joint 15 gets away from the edge of the club face 2. This will increase the durability of the butt joint, and further the rebound performance may be improved. Therefore, it is preferable that the depth FL of the turnback 13 in the back-and-forth direction of the club head is at least 3 mm, more preferably at least 5 mm, but at most 30 mm, preferably not more than 20 mm, more preferably not more than 15 mm.

In the above-described example, the crown opening O1 and crown plate 1B are almost semicircle as best shown in FIG. 2. But, various shapes can be employed as shown in FIGS. 18, 19 and 20.

In FIG. 18, the crown opening O1 is formed within the crown portion 4, and the shapes of the opening O1 and crown plate 1B are heart-shaped or V-shaped, whereby, along the front edge of the opening O1, the width of the annular peripheral part 10 is gradually increased towards the center in the heel-and-toe direction of the head from the toe and heel. In this arrangement, the durability of the joint is most effectively improved because the distance from the face portion to the joint of the crown plate becomes maximum at the center of the club face at which the stress at impact is maximum.

In FIG. 19, the crown opening O1 is formed within the crown portion 4, and the shapes of the opening O1 and crown plate 1B are arrow-shaped, pointing backward. In this example, along the front edge of the opening O1, the width of the annular peripheral part 10 is gradually increased from the center in the heel-and-toe direction towards the feel and toe. Thus, contrary to the FIG. 18 example, the distance is relatively increased on the heel side and toe side when compared with that in the center. Accordingly, in the front end zone of the crown portion, the weight is shifted towards the heel and toe occurs. Therefore, the moment of inertia of the head around a vertical axis passing the center of gravity of the head is increased, and the directional stability can be improved.

In FIG. 20, instead of the single large opening, a plurality of small openings O1 are formed within the crown portion 4. In this example, a large opening similar to that shown in FIG. 2 is divided into two small openings O1 by a bridge extending from the front edge to the rear edge of the large opening. Due to the bridge, the stress acting on the crown plate at impact is mitigated, and the durability can be improved.

Incidentally, carbon dioxide laser, especially YAG (yttrium, aluminum, garnet) laser is preferably used because a high-power, high-energy-density laser beam can be obtained. Laser beam irradiation can be made in the atmosphere or in an inert gas although electron beam irradiation requires to be carried out in a vacuum chamber. Thus, in view of the production efficiency, production cost and the like, the use of laser beam is preferred.

Comparison Tests

Hollow metal wood club heads (volume: 450 cc, Loft angle: 11.0 deg., Lie angle: 57.5 deg.) were made and tested for the durability and measured for the sweet spot height.

All the heads had the same structure except for the crown portion as shown in Table 1.

In each head, the crown plate having the shape shown in FIG. 2 was prepared by pressing a rolled material of a titanium alloy Ti-15V-3Cr-3Al-3Sn. The area of the outer surface of the crown plate was 65 sq.cm.

The main body was formed as follows: An ingot of a titanium alloy Ti-6Al-4V was melted, and the primary casting as shown in FIG. 8 was first formed by lost-wax precision casting. Then, the crown opening was formed in the crown portion by laser beam machining as explained above. The area of the crown opening was almost 65 sq.cm.

The face plate with the turnback as shown in FIG. 4 was formed by hot forging the titanium alloy Ti-5.5Al-1Fe. The thickness t2 of the face portion was 3.2 mm. the face plate was butt welded to the main body by carbon dioxide laser welding.

The crown plate was butt welded to the main body by the welding method shown in Table 1.

The weight of the club head Ex. 1 was 200 grams.

Sweet Spot Height:

As shown in FIG. 3, under the standard state of the head, the height H of the sweet spot SS was measured as a vertical distance from the horizontal plane HP under the standard state of the head. The sweet spot SS is the point of intersection between the club face 2 and a straight line N drawn normally to the club face 2 passing the center of gravity G of the club head.

Durability Test:

The club heads were attached to identical FRP shafts (V-25, flex X, manufactured by SRI Sports Limited) and 45-inch wood clubs were made. Each club was attached to a swing robot (SHOT ROBO, manufactured by Miyamae Co., Ltd), and golf balls were hit 10000 times (max.) at the sweet spot at the head speed of 54 m/sec, while checking the joint of the crown plate and main body. If some kind of damage was found, the hitting was stopped and the number of total hits was recorded. The results are shown in Table 1.

Non-Defective Rate:

With respect to each head, twenty pieces was manufactured, and a percentage of non-defective products was obtained.

The non-defective product means a head satisfying the following conditions (A) and (B): (A) There is no pinhole in the welded butt joint between the crown plate and head main body. (B) The fused zone extends from the outer surface to the inner surface of the crown portion, and it is possible to identify the weld bead on the inner surface.

The inside of the head was observed using an endoscope passed into the head through the shaft inserting hole of the hosel. The outside of the head was observed with the unaided eye. The results are shown in Table 1.

From the test results, it was confirmed that the center of gravity can be lowered, while providing an excellent durability and without lowering the non-defective rate.

The present invention is suitably applied to a wood-type hollow head such as a driver (#1) and fairway wood. But, it can be also applied to iron-type, utility-type and patter-type golf club heads.

TABLE 1

| Head | Ref. 1 | Ref. 2 | Ref. 3 | Ref. 4 | Ref. 5 | Ex. 1 | Ex. 2 | Ex. 3 | Ex. 4 | Ex. 5 |
|---|---|---|---|---|---|---|---|---|---|---|
| Crown plate | | | | | | | | | | |
| Thickness t3 (mm) | 0.50 | 0.53 | 0.51 | 0.49 | 0.50 | 0.50 | 0.52 | 0.45 | 0.48 | 0.50 |
| Main body | | | | | | | | | | |
| Crown peripheral part | | | | | | | | | | |
| Thickness t1 (mm) | 0.7 | 0.7 | 0.7 | 0.7 | 0.7 | 0.7 | 0.7 | 0.7 | 0.7 | 0.7 |
| Crown-plate support | | | | | | | | | | |
| Shape* | C | C | D(60) | C | C | C | C | C | D(75) | C |
| Width RW (mm) | 1.0 | 1.5 | 1.0 | 0.3 | 10.0 | 0.3 | 0.6 | 0.3 | 0.3 | 0.3 |
| Kind of welding | $CO_2$ laser | $CO_2$ laser | $CO_2$ laser | plasma | $CO_2$ laser | $CO_2$ laser | $CO_2$ laser | YAG laser | $CO_2$ laser | $CO_2$ laser |

TABLE 1-continued

| Head | Ref. 1 | Ref. 2 | Ref. 3 | Ref. 4 | Ref. 5 | Ex. 1 | Ex. 2 | Ex. 3 | Ex. 4 | Ex. 5 |
|---|---|---|---|---|---|---|---|---|---|---|
| Fusion zone | FIG. 5 | FIG. 5 | FIG. 5 | — | FIG. 5 | FIG. 5 | FIG. 5 | FIG. 5 | FIG. 5 | FIG. 6 |
| Sweet spot Height H (mm) | 35.1 | 35.5 | 35.3 | 34.5 | 36.5 | 34.5 | 34.8 | 34.3 | 34.0 | 34.8 |
| Non-defective rate (%) | 50 | 20 | 30 | 90 | 10 | 100 | 95 | 95 | 90 | 100 |
| Durability | 7000 | 3000 | 5500 | 1000 | 700 | 10000 non-damaged | 10000 non-damaged | 10000 non-damaged | 10000 non-damaged | 10000 non-damaged |

*Numerical value in parentheses:
Percentage of the total length of the crown-plate support to the inside perimeter of the crown opening.
C: continuous
D: discontinuous

The invention claimed is:

1. A golf club head having a hollow structure comprising
a metallic main body provided in a crown portion with a crown opening and
a metallic crown plate fitted in the opening, wherein
the edge of the crown plate is butt welded to the edge of the main body around the crown opening, and
in the welded butt joint between the crown plate and the main body, a fusion zone of which width is at most 3.0 mm at the outer surface of the crown portion is formed.

2. The golf club head according to claim 1, wherein the crown plate has a thickness of at most 0.60 mm.

3. The golf club head according to claim 1, wherein the fusion zone extends to the inner surface of the crown portion.

4. The golf club head according to claim 1, wherein
the main body is provided in face portion with a front opening, and
the hollow structure further comprises a face plate closing the front opening.

5. The golf club head according to claim 4, wherein the face plate is welded to the main body.

6. A golf club head having a hollow structure comprising
a metallic main body provided in a crown portion with a crown opening and
a metallic crown plate fitted in the opening, wherein
the edge of the crown plate is butt welded to the edge of the main body around the crown opening, and
the main body has a specific gravity, and the crown plate has a specific gravity less than that of the main body.

7. A method for manufacturing a golf club head, the golf club head having a hollow structure comprising a metallic main body provided in a crown portion with a crown opening and a metallic crown plate fitted in the opening, wherein the edge of the crown plate is butt welded to the edge of the main body around the crown opening, the method comprising:
preparing the main body provided along the edge of the crown opening with a crown-plate support having a width of at most 0.8 mm;
fitting the crown plate in the crown opening so that the peripheral edge portion of the crown plate is supported by the crown-plate support; and
butt welding the edge of the crown plate to the edge of the main body around the crown opening by irradiating a laser beam.

8. The method according to claim 7, wherein the crown-plate support is formed continuously along the inside perimeter of the crown opening.

9. The method according to claim 7, wherein the crown-plate support is formed discontinuously along the inside perimeter of the opening.

10. The method according to claim 7, wherein the preparing of the main body includes:
producing a primary casting for forming the main body; and
forming the crown opening in the crown portion of the primary casting by means of laser beam machining.

11. The method according to claim 7, wherein the preparing of the main body includes:
producing a primary casting for forming the main body;
forming the crown opening in the crown portion of the primary casting by means of laser beam machining; and
forming the crown-plate support by means of laser beam machining.

* * * * *